US005190482A

United States Patent [19]

VanDerStuyf et al.

[11] Patent Number: 5,190,482

[45] Date of Patent: Mar. 2, 1993

[54] BULKHEAD CONNECTOR ASSEMBLY

[75] Inventors: Allen F. VanDerStuyf, Novi; Ravindra Patil, Canton; James P. Burgess, Troy; Daniel P. Marshall, Southgate, all of Mich.

[73] Assignee: Electro-Wire Products, Inc., Dearborn, Mich.

[21] Appl. No.: 789,274

[22] Filed: Nov. 8, 1991

Related U.S. Application Data

[63] Continuation-in-part of Ser. No. 611,514, Nov. 13, 1990, Pat. No. 5,100,336.

[51] Int. Cl.[5] ..... H01R 13/00

[52] U.S. Cl. ..... 439/686; 439/733

[58] Field of Search ..... 439/689, 690, 912, 682, 439/684, 686, 733

[56] References Cited

U.S. PATENT DOCUMENTS

| | | | |
|---|---|---|---|
| 2,002,558 | 5/1935 | Von Holtz | 439/690 |
| 2,153,177 | 4/1939 | Ecker | 439/689 |
| 3,621,444 | 11/1971 | Stein | 439/689 |
| 3,781,769 | 12/1973 | Wiley | 439/682 |
| 5,044,962 | 9/1991 | Tomes et al. | 439/689 |

FOREIGN PATENT DOCUMENTS

| | | | |
|---|---|---|---|
| 1164346 | 10/1958 | France | 439/682 |
| 274408 | 9/1964 | Netherlands | 439/682 |
| 64005 | 11/1933 | Switzerland | 439/682 |

*Primary Examiner*—Joseph H. McGlynn
*Attorney, Agent, or Firm*—Krass & Young

[57] ABSTRACT

A terminal connector for retaining and supporting a female electrical terminal. The terminal connector is formed of an electrically insulating material and is configured such that the socket of the terminal and a portion of, but not the entire, edge of the terminal proximate said socket is exposed to allow access to the exposed portion by a probe to permit testing of the terminal.

3 Claims, 6 Drawing Sheets

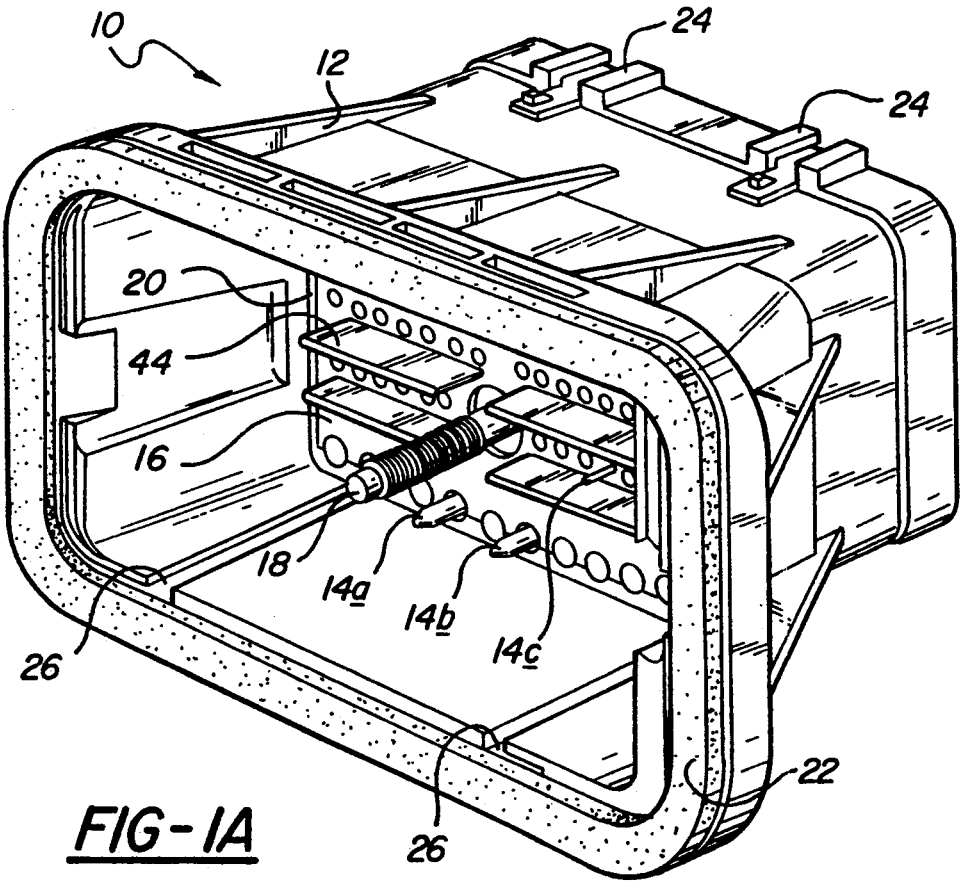
FIG-1A
FIG-1B
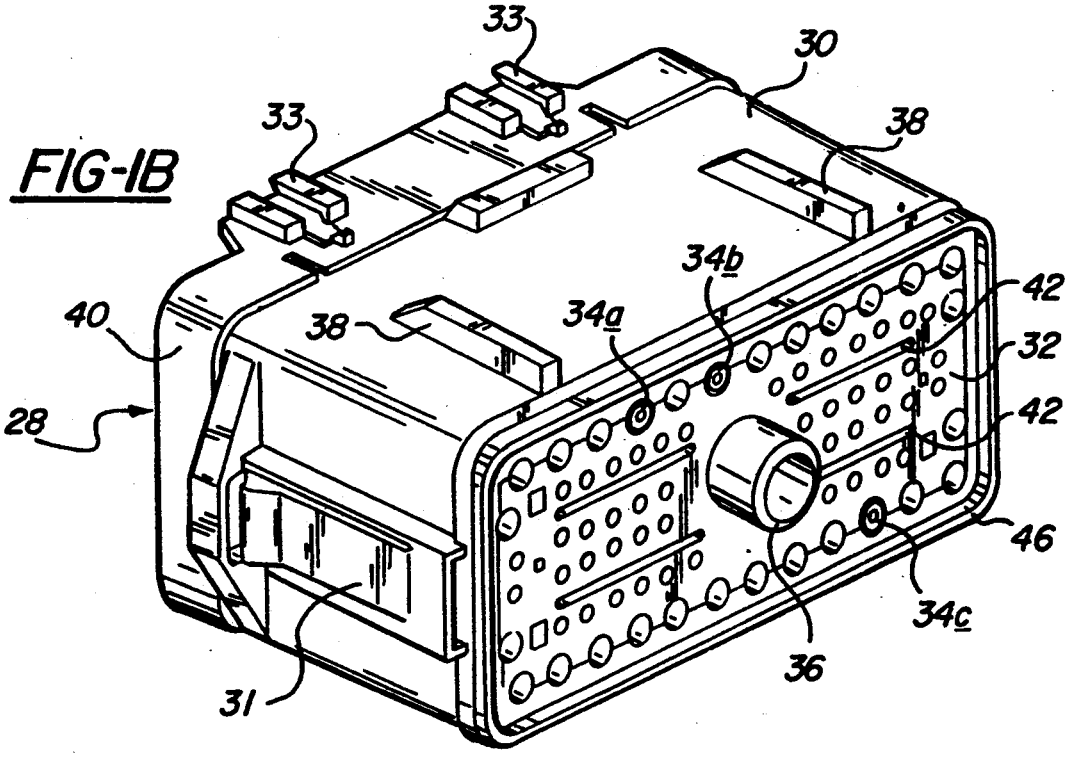

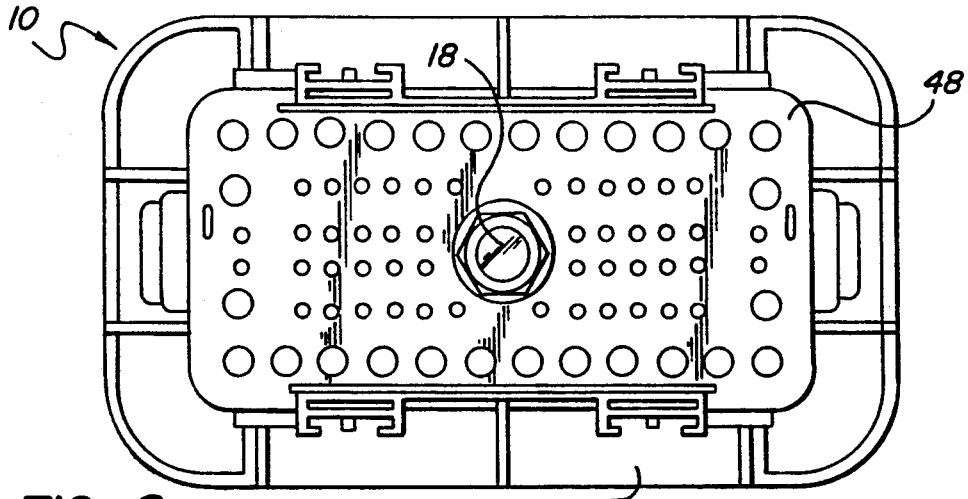
FIG-2
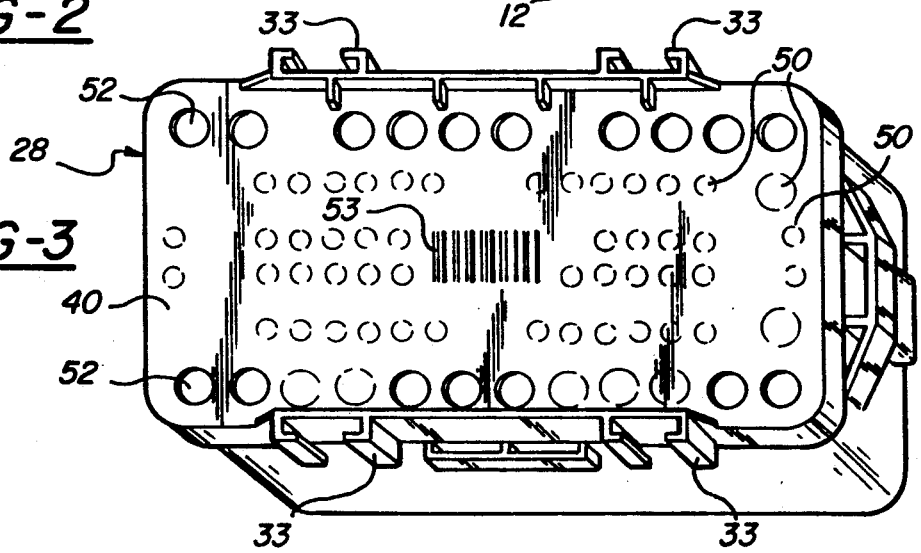
FIG-3
FIG-4
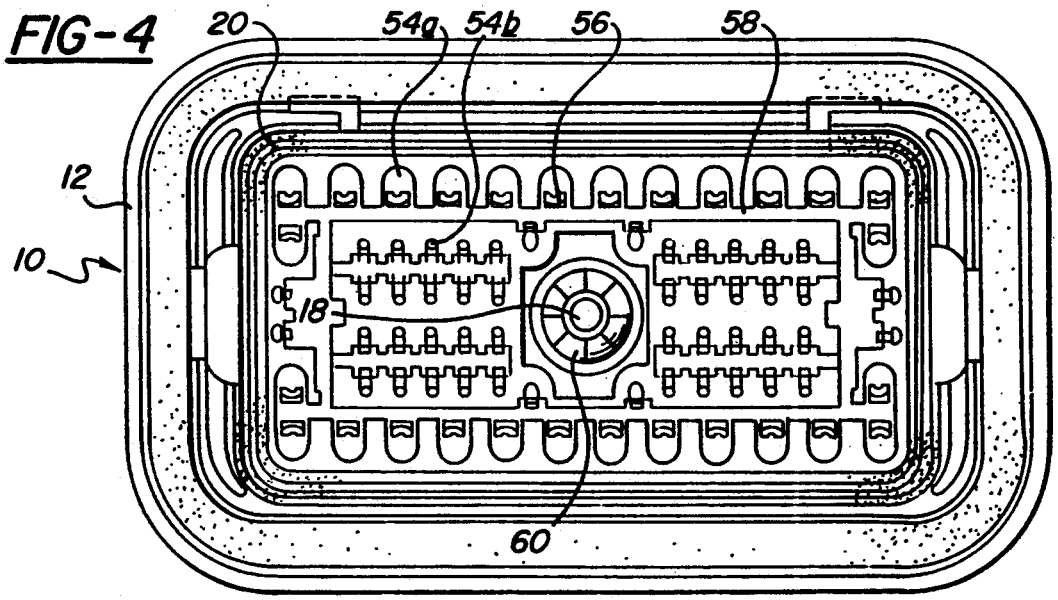

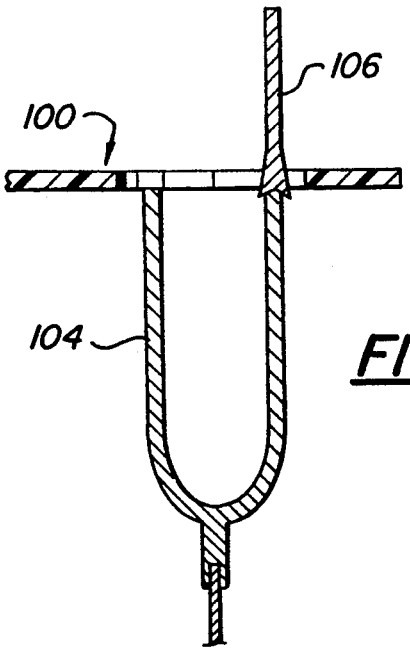
FIG-10B
FIG-11
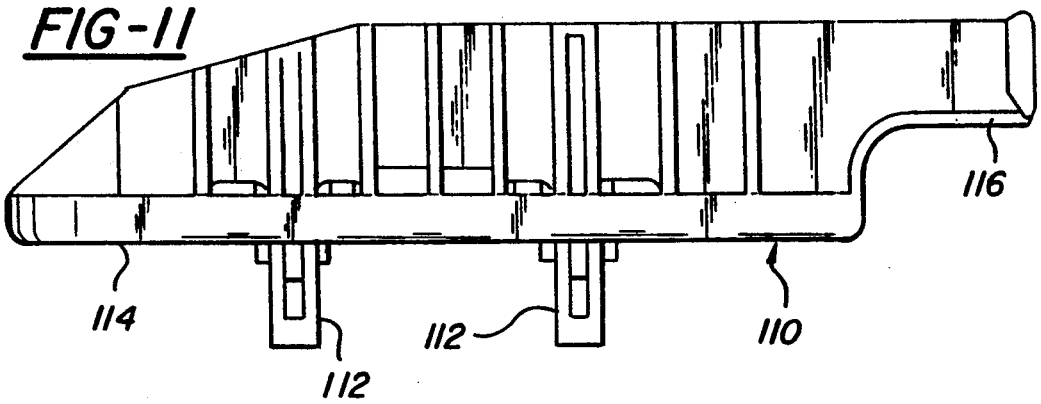
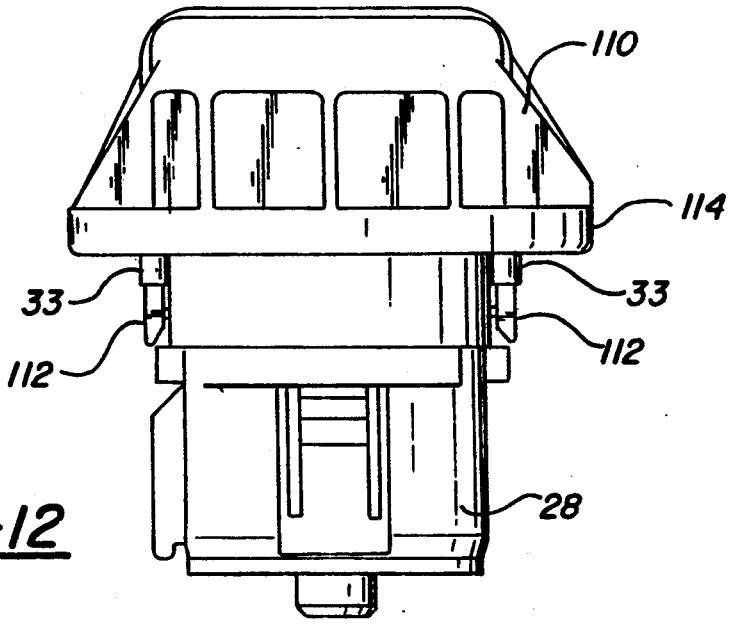
FIG-12

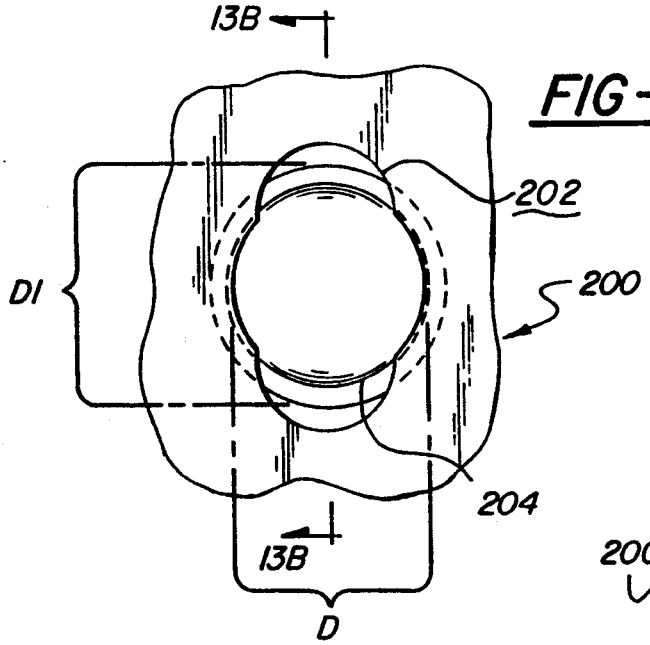
FIG-13A
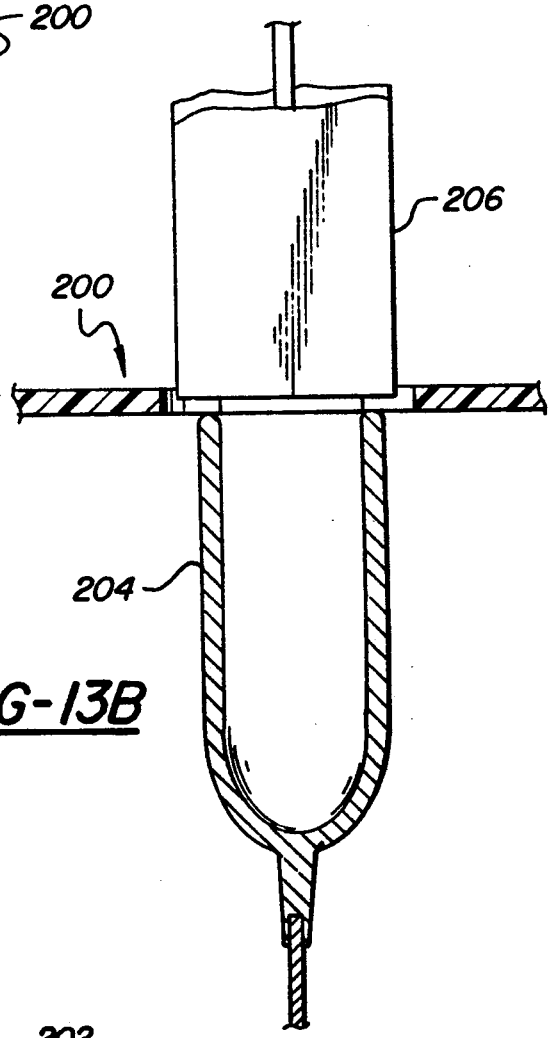
FIG-13B
FIG-14
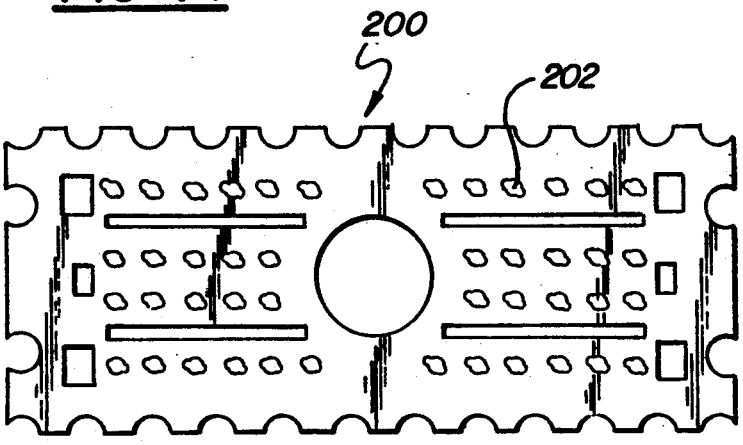

BULKHEAD CONNECTOR ASSEMBLY

REFERENCE TO RELATED APPLICATION

This is a continuation-in-part of application Ser. No. 611,514, filed Nov. 13, 1990, now U.S. Pat No. 5,100,336.

FIELD OF THE INVENTION

This invention relates generally to electrical connectors and particularly to multi-terminal electrical connectors. More specifically the invention relates to an environmentally sealed, multiple terminal connector which may be configured into a variety of terminal combinations.

BACKGROUND OF THE INVENTION

The electrical systems of motor vehicles of all types are becoming increasingly complex. Generally, motor vehicles are provided with a wiring harness, which is a prefabricated bundle of wires having appropriate terminals for interconnection of the appropriate electrical components and subsystems of the vehicle. Often, a wiring harness, or a portion thereof, must pass through a bulkhead. As used herein, the term "bulkhead" is meant to include fire walls, acoustical barriers, dash panels pressure resistant walls and the like. Generally, it has been found most advantageous to utilize multiple terminal connectors to convey a number of electrical terminals through such bulkheads. Additionally, multiple terminal connectors are employed in other situations, both vehicular and non-vehicular where very large numbers of electrical terminals must be reversibly interconnected.

It is necessary that any multiple terminal electrical connector provide for the rapid, accurate, reversible and reliable interconnection of the appropriate wire pairs. Generally, most multiple terminal connectors comprise a pair of matable base members, each having one or more of the appropriate terminals retained therein. The base members maintain the terminals in the appropriate orientation and allow for ready connection and disconnection thereof. In most vehicular applications, it is further desirable that the connectors provide for the environmentally sealed interconnection of the terminals so as to prevent failures due to moisture or corrosion. It is additionally desirable that the connectors be immune to loosening from vibration or other mechanical impact.

A noise free passenger environment is generally quite important in automobiles, aircraft and other motor vehicles; and toward this end, manufacturers frequently soundproof the passenger compartment. For example, in automotive construction, sound from the engine compartment is excluded from the passenger compartment by a layer of relatively thick sound absorbing material disposed upon the dash panel bulkhead. It has been found that gaps even as small as 2–3 millimeters in the soundproofing will allow intolerable levels of engine noise to pass into the passenger compartment. Any type of connector passing through the bulkhead should be configured so as to preclude any gaps in the sound barrier which could pass noise therethrough.

There are a great variety of multiple terminal connectors known in the prior art and adapted for use in vehicular applications. For example, U.S. Pat. No. 4,179,179 discloses a multiple terminal electrical connector assembly developed for automotive use. While this connector does provide for the passage of terminals through a bulkhead wall, this particular terminal typifies problems of the prior art insofar as it is configured for one particular application and not readily reconfigurable. A given wiring harness is generally specific for a given model of vehicle, and in some instances will even vary within a particular model depending upon options, accessories and other ancillary equipment. The prior art has required manufacturers to employ a differently configured connector for each variant of wiring harness. Clearly, there are many problems associated with the inventory and handling of many different connectors. Aside from the obvious expense of maintaining a complicated and extensive stock, further problems arise from the inadvertent installation of the wrong parts. The socket of the connector in the U.S. Pat. No. 4,179,179 is configured so that it may receive several alternative plug members and hence some limited flexibility of application is possible. However, a multiplicity of plug members must be stocked and the number of different configurations attainable with a connector of this type is fairly small; thus it is not a "universal" connector.

The U.S. Pat. No. 4,179,179 connector, as is typical of many such connectors, includes a bolt for rigidly interconnecting the two portions. It has been found that the presence of the bolt can detrimentally affect the quality of the electrical connections because the bolt serves as a point for passage of ambient moisture to the interior of the connector and such moisture can corrode or otherwise breach electrical contact between the terminals.

It should be clear from the foregoing, that there is a need for a multiple terminal electrical connector which can be disposed in a number of alternative configurations to reliably and rapidly establish a multiplicity of electrical interconnections. It is further desired that such a connector maintain the appropriate polarity of the connections and that it provide a thorough environmental seal at the point of connection. It if further desired that the connector be compatible with, and not detract from, sound proofing methods employed in vehicular construction. The present invention provides for a simple to use, inexpensive multiple terminal connector. The connector of the present invention may be employed in various configurations to interconnect differing numbers and dispositions of terminals. Furthermore, the connector of the present invention includes unique sealing structures to prevent environmental contamination of the electrical contacts. The present connector is particularly well suited for interconnecting various portions of vehicular wiring systems; however, it should be appreciated that a connector of this type also finds utility in many non-vehicular applications. These and other advantages of the present invention will be readily apparent from the drawings, discussion and description which follow.

BRIEF DESCRIPTION OF THE INVENTION

There is disclosed herein a bulkhead connector which comprises a male base member and a female base member configured to be matingly engagable. Each base member is fabricated from a dielectric material and each defines a plurality of sockets therein configured to receive an electrical terminal member. The connector further includes a wedge member retained in at least one of said base members and being operable in cooperation with the socket of the base member to retain said electrical terminal member. The connector further includes a gasket disposed proximate the periphery of a first one of said base members and including a groove extending the length thereof, as well as a flange associated with the other of the base members. The flange is configured to engage the groove when the male and female base members are matingly engaged. The connector also includes a generally elongated locking bolt disposed so as to pass through at least one of the base members and a locking bolt socket configured to engage the locking bolt. The bolt and socket are operable in combination to retain the male and female base members in mated engagement. The connector also includes an elastomeric bolt seal configured as a sleeve extending along at least a portion of the length of the locking bolt.

In a particular embodiment, the wedge member is retained in the base member so as to be biasable from a first preloaded orientation wherein the terminal member may be readily inserted into the socket to a second, locked orientation wherein the wedge and socket cooperate to retain the terminal. In yet other embodiments, at least one of the male and female base members includes a back cover, and this cover may include a plurality of removable closure members corresponding in number and location to the sockets of the base member. This cover may be configured to accommodate a variety of terminal configurations by removal of the appropriate closure members. In a further embodiment, the base member of the connector includes a sealing grommet disposed upon a first face thereof. The grommet has a plurality of openings defined therein corresponding in number and location to the number and location of the sockets and the closure members of the cover each include a projecting pin configured to enter into, and seal, the openings in the grommet.

In yet another embodiment, the connector includes a noise and vibration suppressing cover associated with one of the base members. The cover attaches to the connector and generally extends beyond the periphery thereof and is operable to effect a seal between itself and the vehicle bulkhead to prevent transmission of noise and vibration therethrough.

BRIEF DESCRIPTION OF THE FIGURES

FIG. 1-A is a perspective view of the female connector portion of a bulkhead connector assembly structured in accord with the principles of the present invention;

FIG. 1-B is a perspective view of the male connector portion of a bulkhead connector assembly structured in accord with the principles of the present invention;

FIG. 2 is a rear, plan view of the female connector of FIG. 1-A;

FIG. 3 is a rear perspective view of the male connector of FIG. 1-B showing the configurable back cover thereof;

FIG. 4 is a front, plan view of the female socket of FIG. 1-A with the wedge member removed;

FIG. 8-B of is a cross-sectional view of the socket of FIG. 8-A together with a portion of a wedge member as operable to retain a male terminal therein;

FIG. 8-C is a cross-sectional view of a socket and wedge member generally similar to that shown in FIG. 8-B, as operable to retain a female terminal therein.

FIG. 10B is a sectional view of the wedge member and terminal of FIG. 10A, taken along line 10B—10B;

FIG. 11 is a side elevational view of a noise and vibration suppression cover of the present invention;

FIG. 12 is an end view of the cover of FIG. 11 as attached to a male connector similar to that of FIG. 1B;

FIG. 13A is a top plan view similar to FIG. 10A showing an alternate configuration of the elongated opening;

FIG. 13B is a section view of the wedge member and terminal of FIG. 13A, taken along line 13B—13B; and FIG. 14 is a top plane view of a wedge member showing the arrangement of the elongated openings shown in FIG. 13A.

DETAILED DESCRIPTION OF THE INVENTION

Figure 5:
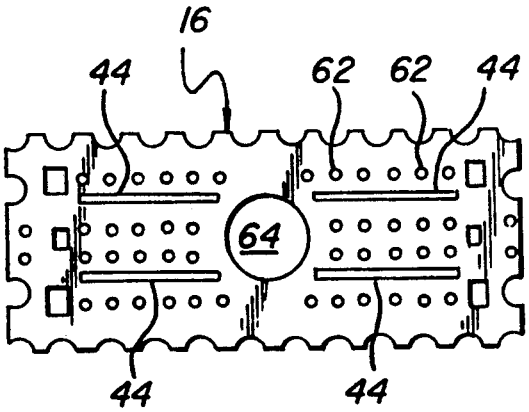
FIG. 5 is a top, plan view of the wedge member employed in conjunction with the female connector.

The bulkhead connector assemblies of the present invention may be fabricated in a variety of designs and configurations. The figures, particularly FIGS. 1-4 depict one particular design of connector assembly of the present invention. Referring now to FIG. 1-A, there is shown a perspective view of the female portion of the connector assembly of the present invention. The female connector 10 comprises a base member 12 fabricated from a dielectric material, such as a thermoplastic or thermosetting resin, and configured to define a number of sockets (better illustrated in succeeding figures). The sockets are each configured to receive and retain an electrical terminal member therein and in the illustration of FIG. I-A, three terminal members 14*a*, 14*b* and 14*c* are depicted, it being understood that the connector assembly of the present invention may be readily adapted, at or prior to, the time of use, to retain various numbers and configurations of electrical terminals.

The female connector 10 further includes a wedge member 16 therein which, as will be explained in greater detail hereinbelow, operates in cooperation with the sockets to fixedly retain the terminals 14 and/or to verify the proper seating of the terminals 14. The female connector 10 further includes a locking bolt 18 retained therein and operable in cooperation with a socket disposed in the corresponding male member to lock the connector assembly of the present invention in mated engagement.

The female connector 10 still further includes a sealing gasket 20 disposed proximate the interior periphery thereof (and better seen in FIG. 4). This gasket 20 includes a groove and operates in cooperation with a corresponding flange on the male connector to effect a moisture tight seal therebetween. The female connector 10 also may include a bulkhead sealing gasket 22 disposed proximate the exterior periphery thereof. This gasket 22 seals the connector assembly to the periphery of a bulkhead opening preventing passage of noise and exterior atmosphere therethrough. The base member 12 of the female connector 10 may be configured for particular mounting applications and toward that end includes a pair of mounting lugs 24 molded therein. As illustrated, the base member also includes a pair of molded-in channels 26 configured to engage with corresponding members in the male connector to assure maintenance of proper polarity.

Referring now to FIG. 1-B, there is shown in perspective, the male connector 28 of the bulkhead connector assembly as configured to matingly engage the female connector 10 of FIG. 1. As illustrated, the male connector 28 includes a base member 30, a number of sockets defined therein and a wedge member 32 operative in cooperation with the sockets, as will be described in greater detail hereinbelow to retain a number of electrical terminals 34*a–c* therein. The male connector 28 further includes a locking bolt socket 36 configured and disposed to engage the locking bolt 18 of the female connector 10 of FIG. 1.

The base member 30 of the connector 28 of FIG. 1B includes a pair of molded-in guide lugs 38 for engaging the slots 26 in the base member 12 of the connector 10 of FIG. 1-A. As illustrated, the male connector 28 of FIG. 1-B further includes a rear cover 40 which will be described in greater detail hereinbelow. The wedge member 32 of the male connector includes a number of slots 42 defined therein. These slots are disposed and configured to matingly engage corresponding tabs 44 on the wedge member 16 associated with the female connector 10 of FIG. 1-A. As will be explained in greater detail hereinbelow, the wedge members 16 and 32 associated with the female 10, and male 28, connectors, respectively may be biased from a first, preloaded position wherein they allow the ready insertion of terminal members into the sockets, to a second, seated, position wherein they cooperate with the socket to lockingly engage and retain the terminal members.

It will also be noted that the base member 30 of the male connector 28 of FIG. 1-B further includes a flange member 46 disposed about the periphery thereof and configured to engage the grooved gasket 20 of the female connector 10 so as to effect a vertical seal therebetween. This vertical seal is in contradistinction to a more standard type of butt or T-seal and provides for an extended, longitudinal contact surface which presents a greatly improved barrier to moisture or other contaminants. A vertical seal of this type also accommodates thermal expansion and contraction of the assembly, and this feature is important since it has been found that normal thermal cycling produces variations of at least 1/32 inch which can compromise a butt or T seal.

The base member 28 further includes molded-in mounting clips 31 which function to retain the base member 28 when it is pressed into an opening in a sheet metal body panel. These clips generally provide temporary support for the base member until it is mated and secured with the female base member.

Referring now to FIG. 2, there is shown a rear, plan view of the female connector 10 of FIG. 1. Visible is the back portion of the base member 12, the head of the attachment bolt 18 and a rear cover 48. This cover 48 includes a number of openings therein; in this particular embodiment the cover 48 includes seventy-six openings corresponding in number and location to the seventy-six sockets in the connector of the sockets. In use, electrical terminal members are inserted through these openings and the wire portions thereof protrude therefrom. The rear cover 48 may have an additional gasket associated therewith and disposed therebeneath. The gasket preferably includes openings corresponding to the openings in the rear cover and is operative to seal the wires associated with terminal members passing therethrough. The rear cover 48 may be provided prepunched as illustrated; or as illustrated in FIGS. 3 and 9, the cover 48 may be configurable to accommodate various combinations and dispositions of terminals.

Referring now to FIG. 3, there is shown a rear perspective view of the male connector 28 better illustrating the rear cover 40 thereof. As mentioned previously, this rear cover 40 may be configured to accommodate a variety of terminal arrangements. As provided, the cover 40 includes a number of knock-out closures 50 corresponding to potential terminal locations. As illustrated, particular of the knock-out closures have been removed to create a pattern of openings 52 in the rear cover 40. Since only those portions of the cover 40 which correspond to terminal locations are opened, the environmental sealing of the connector is improved.

As illustrated, the rear cover 40 is separate from the remainder of the connector 28; and accordingly, the rear cover may be supplied in a preconfigured form wherein the appropriate openings are included; or alternatively, the cover 40 may be supplied with the aforementioned knock-out closures. In the latter instance, the cover 40 is configured as needed by removing the appropriate closures. It is anticipated that in high volume applications, the cover may be configured in an automated process. By utilizing such on-site configuration, maintenance of an inventory of particular covers is eliminated. As indicated, the cover 40 may include indicia, such as a bar code 53 or other machine or human readable characters to indicate the particular configuration thereof.

Figure 9:
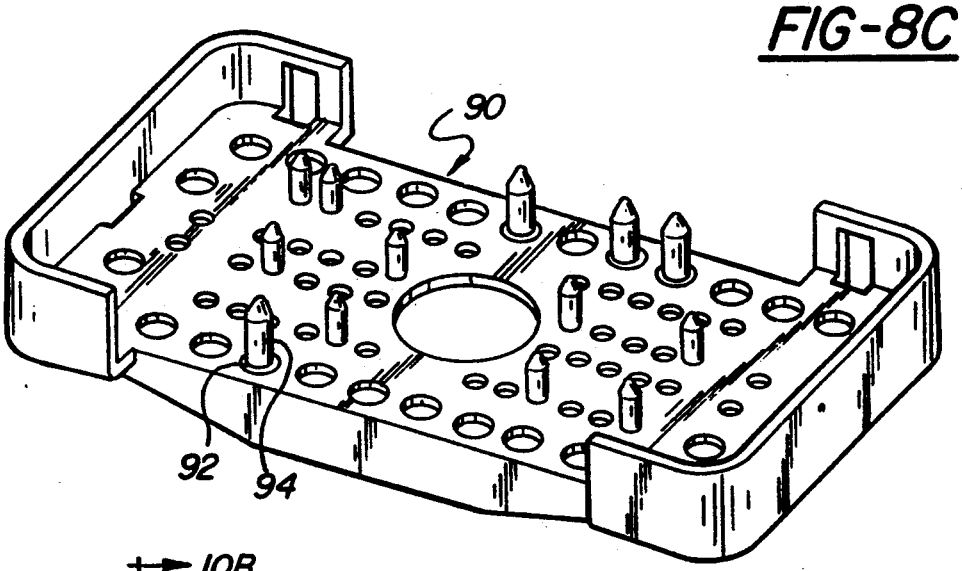
FIG. 9 is a perspective view of another embodiment of configurable back cover.

Referring now to FIG. 9, there is shown yet another variation of cover 90, structured in accord with the principles of the present invention. As illustrated, this cover 90 includes a plurality of removable closure members 92, as in the cover of FIG. 2; however, these closure members 92 each include a pin 94. Generally, the connector assemblies disclosed herein include an elastomeric sealing grommet disposed on the rear face thereof. The grommet is a sheet-like member which includes a number of openings therethrough corresponding in number and location to the sockets. The grommet is operative to provide a moisture-tight seal around wires passing therethrough to terminals in the socket and the pins 94 of the closure members 92 of the FIG. 9 cover 90 are operative to seal the openings in unused portions of the grommet.

The FIG. 9 cover 90 may be configured for a variety of applications by removing the appropriate closure members. In this regard, it is similar to the cover of FIG. 2. It will be noted from the illustration of FIG. 9 that the cover 90 includes a large central opening therethrough. This is to accommodate an attachment bolt. Obviously, this design of cover may be made without central opening if it is to be affixed to a connector not including an attachment bolt.

Referring now to FIG. 4, there is shown a front plan view of a female connector 10 of the assembly of the present invention having the wedge thereof removed so as to better illustrate the sockets 54. As illustrated, the connector includes 76 sockets which are of two different sizes. A group of larger sockets 54*a* is configured to retain fairly large size terminals therein while a second group of smaller sockets 54*b* is configured to retain smaller terminals therein. It will be appreciated that in accord with the principles of the present invention, differing numbers of sockets as well as other sizes of sockets may be disposed in a connector without departing from the scope of spirit of the present invention. As illustrated, each socket includes a locking finger 56 associated therewith. This finger is typically formed integrally with the base member 12 of the connector 10 and, as will be explained in greater detail hereinbelow, operates to retain a terminal inserted into the socket 54.

It will be noted that the base member 12 of the connector 10 is configured to include a wedge receiving groove 58 and that the locking fingers 56 are disposed along the groove. This orientation is important because, when the wedge is inserted, it operates to bias the locking fingers 56 so as to retain the terminals. FIG. 4 also better illustrates the grooved sealing gasket 20 and shows the locking bolt 18 as well as a retaining washer 60 associated therewith.

Referring now to FIG. 5, there is shown a top plan view of the locking wedge 16 of the female connector. The wedge 16 includes a number of openings therein configured to permit passage of the terminals therethrough. The openings for the smaller terminals are generally configured as entire holes 62 while the openings for the larger terminals are semicircular cut outs along the perimeter of the wedge 16. The wedge also includes a central opening 64 for passage of the locking bolt. Also visible in the drawing are four mating flanges 44 which engage corresponding recesses in the locking wedge of the male connector and serve to guide and fix the two in mated engagement.

Figure 6:
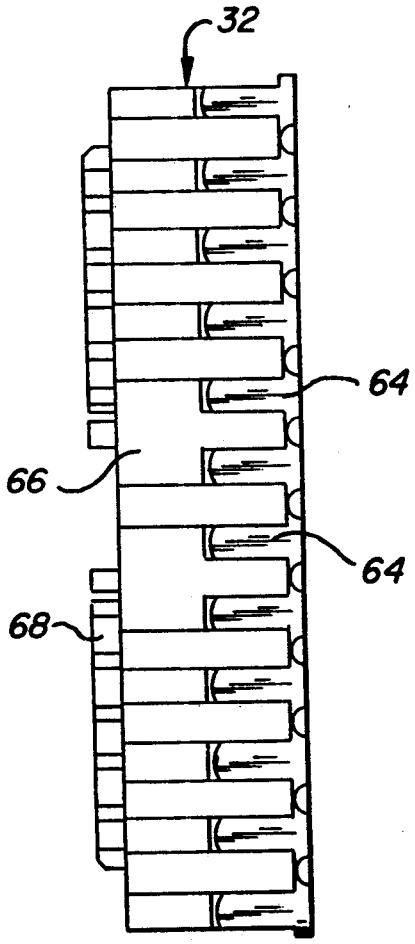
FIG. 6 is a side, elevational view of the wedge member employed in with the male connector.

Referring now to FIG. 6 there is shown a side, elevational view of the male wedge 32. It will be understood that the top view thereof is generally similar to that of the female wedge 16 of FIG. 5, except that the flanges are replaced by corresponding recesses. Visible in the FIG. 6 drawing are a number of raised, locking finger actuating ramps 64 disposed upon the side wall 66 of the wedge 32. These ramps 44 bias the locking fingers so as to lock a terminal into the connector, when the wedge is fully seated. It will be noted that the ramps 64 extend along only a portion of the length of the side wall 66. This arrangement allows for the wedge to be partially inserted into the connector without biasing the locking fingers. This feature is quite important to assembly of the connector since it permits the wedge to be partially inserted without actually effecting the locking. Thus, the wedge 32 may be preloaded into the connector prior to the final placement of all of the terminals, and subsequently fully seated causing the ramps 64 to lock the terminals.

Also visible in the FIG. 6 view are portions of the internal walls 68 of the wedge 32. These walls 68 are disposed to bias the locking fingers of the internal (i.e., non-peripheral) terminals in a similar manner. It is to be noted that while the external wall 66 is shown as having discrete wedges 64, other configurations will allow for a wedge Which may be preloaded. For example, the wedges 64 need not be separated; instead, the wall 66 may simply be provided with portions of two different thicknesses. The upper portions may be made relatively thicker than the lower portions so as to bias the locking fingers when fully seated. Such an arrangement is particularly advantageous for the smaller terminals.

Figure 7:
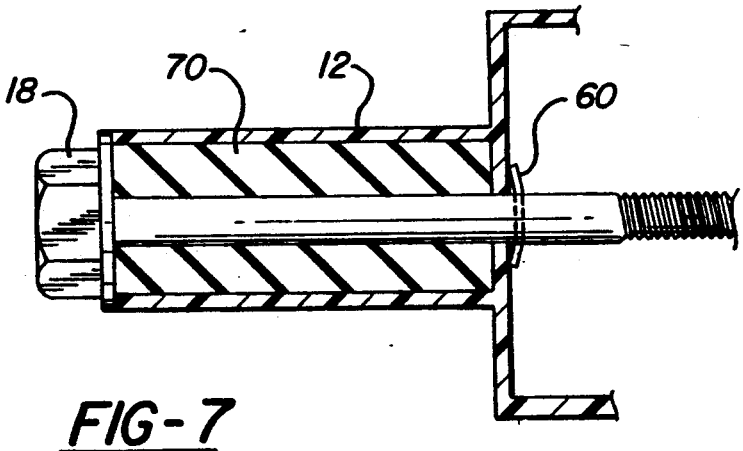
FIG. 7 is a cross-sectional view of a portion of the female connector illustrating the locking bolt and its associated gasket.

As mentioned hereinabove, environmental seal of the connector assembly is quite important to prevent corrosion and subsequent degradation of electrical contact between the terminals. Referring now to FIG. 7, there is shown a cut-away view of a portion of the base member 12 of the female connector illustrating the locking bolt 18 and an elastomeric seal 70 associated therewith. As illustrated, the bolt 18 passes through a portion of the base member 12 of the female connector and is retained therein by a locking washer 60. The base member 12 is configured to include an elongated sealing portion enclosing a relatively long elastomeric seal 70 fabricated from silicone rubber, natural rubber, synthetic rubber or other polymeric material. It is particularly preferred that the elastomeric seal be fabricated from a highly hydrophobic material such as silicone rubber or fluorocarbon materials so as to prevent the creep of water thereinto by capillary action. The seal 70 engages a portion of the length of the bolt 18 which is greater than the bolt's diameter and provides for a large sealing area which prevents entry of moisture or other contaminants into the interior of the connector assembly.

Figure 8A:
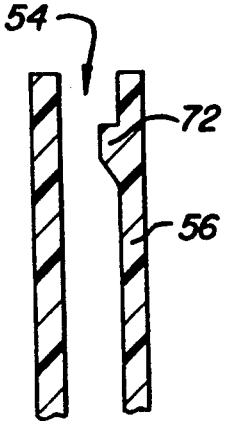
FIG. 8-A is a cross-sectional view of a portion of a socket of the type employed in the present invention.
Figure 8B:
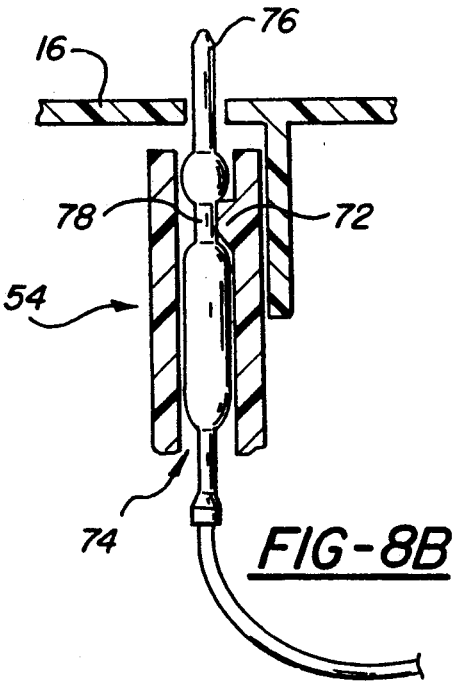
Figure 8C:
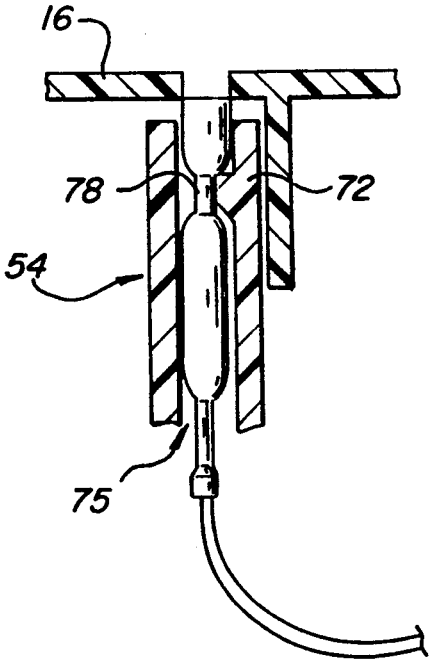

Referring now to FIG. 8-A, there is shown a portion of one of the sockets 54 as employed in the present invention to retain electrical terminals therein. The socket 54 is typically molded integral with the base member of the corresponding connector and includes a locking finger portion 56 associated therewith. This locking finger is fabricated from a resilient material, and in the instance where the base member is molded from a polymeric material, the locking finger 56 may be simply molded integral therewith. The locking finger 56 includes a locking lug 72 which retains the terminal.

Referring now to FIG. 8-B, there is shown a cutaway view of a portion of one of the connectors of the present invention illustrating a socket 54 as described hereinabove, including a locking finger 56 and having an electrical terminal member 74 retained therein. FIG. 8B further illustrates a portion of a locking wedge 16 as disposed to lock the terminal 74 into the socket 54. As illustrated in the figure, the terminal 74 is a conventional pin-type terminal, in this instance a male terminal. These are staple items of commerce and as shown include a terminal portion 76, in this instance a pin; although obviously, a socket may be similarly disposed. FIG. 8-C illustrates a female terminal 75 as similarly retained in a socket 54. The terminal 74 further includes a narrowed portion 78.

As will be noted, the locking finger 56 includes a locking lug 72 having a ramped forward surface. This permits the terminal 74 to be inserted readily and once it is in position, the lug 72 engages the narrowed portion 78 of the terminal 74. Insertion of the wedge 16 biases the locking finger 56 so as to tightly and permanently engage the narrowed portion 78 with the lug 72.

In addition to locking the terminal 74 in place, the wedge 16 also functions to provide verification of proper seating of the terminal 74 in the socket 54. In those instances where the terminal 74 is not fully seated, the lug 72 of the locking finger 56 will not engage the narrowed portion 78 of the terminal, but will rest upon a wider portion thereof and will consequently be biased in a direction away from the terminal 74. When in this position, the locking finger 56 prevents seating of the wedge. This constitutes an important inspection feature provided by the present invention and it is to be noted that such verification of terminal placement occurs independent of the retention of the terminal 74 by the locking finger 56. In some instances, terminals 74 are provided with narrowed portions 78 which join to the remainder of the terminal via nearly perpendicular walls and in such instance, the terminal may be retained by an appropriately configured locking finger without the use of a wedge; however, use of the wedge is still generally preferred for purposes of verifying proper terminal placement.

In some instances, it is desirable to electronically test each of the electrical terminal connections prior to installation of the connector assembly so as to assess the continuity thereof. Such testing is accomplished by mechanically contacting the electrical terminal member with a conductivity probe and assessing the integrity thereof. It is generally desirable to avoid inserting the probe into the cavity of female connectors since such probes can damage the connectors, thereby preventing establishment of proper connection when assembled.

Figure 10A:
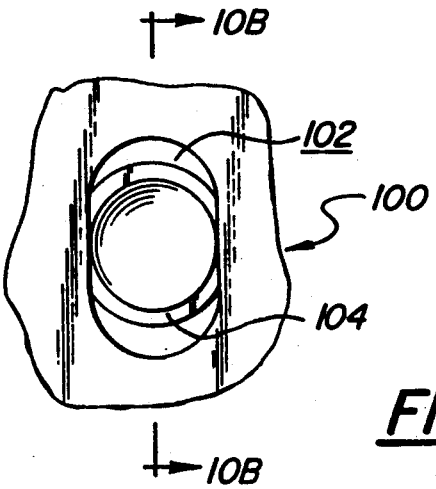
FIG. 10A is a top plan view of a portion of a wedge member of the present invention of the type including an elongated opening therein as operative to retain an electrical terminal.

Referring now to FIGS. 10A there is shown a portion of the top face of a wedge member 100 generally similar to the wedge member 16 illustrated with reference to FIG. 5. What is notable about this wedge member is the fact that the opening 102 therein is generally elongated. The elongated opening 102 has a major axis which is greater than the diameter of an underlying electrical terminal 104 and a minor axis which is less than the diameter of the terminal 104. In this manner, the opening 102 provides access to a significant portion of the edge of the terminal 104. This access enables contact of the edge by a probe.

Referring now to FIG. 10B, there is shown a cross-sectional view of the face 100 of the wedge taken along line 10B—10B. As illustrated, the terminal 104 is exposed in the opening and its edge may be readily contacted by a measuring probe 106 so as to allow for ready testing of the electrical integrity thereof without he necessity of entering, and possibly damaging, the internal cavity of the terminal 104.

Referring now to FIG. 13A there is shown a portion of the top face of a wedge member 200 generally similar to the wedge member 100 illustrated with reference to FIG. 10A. In this wedge member, the elongated opening 202 is in the form of a circular aperture superimposed on a slot (or vice versa). The diameter D of the circular aperture is less than the diameter D1 of the terminal 204. That is, a portion, but not all, of the edge of terminal 204 is exposed for probe testing.

Referring now to FIG. 13B, there is shown a cross-sectional view of the face of the wedge 200 taken along line 13B—13B. As illustrated, the terminal 204 is exposed in the opening and a portion of its edge may be readily contacted by a measuring probe 206, without inserting probe 206 into cavity 208, so as to allow for ready testing of the electrical integrity thereof as explained before.

FIG. 14 shows how the openings 202 are arrayed on the face of a locking wedge 216. The slots of the openings 202 are angularly oriented so that there will be sufficient spacing between openings 202.

In many instances, it is desirable to limit the access of noise, vibration and harmonic resonances into the interior of a vehicle. While the bulkhead connector of the present invention, as hereinabove described, provides a superior noise seal, further attenuation of sound may be achieved by including an auxiliary cover in combination with the bulkhead connector assembly.

In FIGS. 11 and 12, one such noise and vibration suppression cover 110 is shown. Referring now to FIG. 11, there is shown a side elevational view of a noise and vibration suppression cover 110 as configured to attach to one of the base members of the bulkhead connector of the present invention. The cover 110 includes a pair of locking tabs 112 which engage correspondingly shaped channels in the connector. The cover includes a large sealing flange 114 disposed about the periphery thereof and a conduit portion 116 for guiding and conveying electrical leads from the connector assembly.

Referring now to FIG. 12, there is shown an end view of a male portion 28 of the connector assembly, generally similar to the male connector 28 of FIG. 1B and having a noise and vibration suppression cover 110 affixed thereto. As will be noted, the cover 110 is affixed to the connector 28 by means of the mounting tabs 112 operating in connection with slots 33. The flange portion 114 of the cover 110 extends beyond the periphery of the male connector 28 and operates to effect a tight seal against the material of the vehicular dash panel. Obviously, other designs of cover may be similarly employed and may be structured to operate in cooperation with a female portion of the connector assembly in a similar manner.

It will be appreciated that the present invention provides a connector assembly which may be readily configured to accommodate a large number of different electrical terminals disposed in a variety of orientations. The connector of the present invention may thus be considered universal in the sense that it may be applied to a variety of situations. By utilizing the present invention, a manufacturer need only warehouse a relatively small number of different parts to provide connector assemblies custom suited to a variety of vehicular applications. The connector of the present invention is readily manufactured from moldable thermoplastic or thermosetting compounds such as polystyrene, melamine, ABS and phenolics, as well as a variety of other synthetic polymeric materials.

It will be appreciated that the foregoing has described one particular embodiment of connector assembly; the present invention is not so limited and may be fabricated with a greater or smaller number of terminal sockets as well as terminal sockets of different sizes. Additionally, while the present invention was depicted as employing a single wedge for each of the male and female connectors, in some instances it may be desirable to provide each connector with two or more discrete wedges, depending upon the particular configuration thereof. These and other modifications and variations will be readily apparent to one of skill in the art in light of the foregoing drawings, discussion and description. Therefore, it is to be understood that the foregoing is merely illustrative of particular embodiments of the present invention and is not a limitation upon the practice thereof. It is the following claims, including all equivalents, which define the scope of the invention.

We claim:

1. An electrical terminal comprising a base member fabricated from a dielectric material and defining a terminal retaining socket therein, said socket having associated therewith a locking finger, said socket and finger being operative in combination to receive and retain a female electrical terminal therein, said base member further including a wedge receiving groove defined therein proximate said locking finger; and a locking wedge comprising a top face portion which has a side wall portion projecting perpendicularly therefrom, said side wall portion configured to fit into the wedge receiving groove of the base member and including a locking finger actuating ramp associated therewith, said ramp operative, when the side wall portion is fit into the groove, to bias the locking finger into engagement with a terminal disposed in the socket; the top face portion including an opening defined therein at a location which corresponds to said socket when the side wall portion is fit into the groove, said opening being configured so that the top face covers a first portion of an edge of the terminal but exposes a second portion of the edge of the terminal so that the terminal may be contacted by a test probe.

2. A connector as in claim 1, wherein said opening is configured as an elongated slot superimposed on, and extending beyond, the circumference of a circle.

3. An electrical connector as in claim 1, wherein said base member includes a plurality of terminal retaining sockets, each having one of said locking fingers associated therewith and wherein said locking wedge is operative to bias the locking fingers and wherein the top face portion of said wedge includes a plurality of openings defined therein, each opening disposed at a location which corresponds to one of said sockets and each opening being configured so that the top face covers a first portion of an edge of each of the terminals but exposes a second portion of the edge of each of said terminals.

* * * * *